US005487540A

United States Patent [19]

Bixler et al.

[11] Patent Number: 5,487,540

[45] Date of Patent: Jan. 30, 1996

[54] APPARATUS FOR USE IN PRACTICING THE FUNDAMENTALS OF BASKETBALL

[76] Inventors: Dickie R. Bixler; Jessica A. Bixler, both of Rte. 1, Box 33, Dacoma, Okla. 73731

[21] Appl. No.: 445,679

[22] Filed: May 22, 1995

[51] Int. Cl.[6] ..... A63B 69/00

[52] U.S. Cl. ..... 273/1.5 A

[58] Field of Search ..... 273/1.5 A, 394–397

[56] References Cited

U.S. PATENT DOCUMENTS

| | | | |
|---|---|---|---|
| 3,776,550 | 12/1973 | McNabb | 273/1.5 A |
| 4,579,340 | 4/1986 | Jenkins et al. | 273/1.5 A |
| 4,678,189 | 7/1987 | Koss | 273/1.5 A |
| 4,714,248 | 12/1987 | Koss | 273/1.5 A |
| 5,060,940 | 10/1991 | Mullen | 273/1.5 A |
| 5,312,099 | 5/1994 | Oliver, Sr. | 273/1.5 A |

*Primary Examiner*—Paul E. Shapiro
*Attorney, Agent, or Firm*—Head & Johnson

[57] ABSTRACT

An apparatus for use in practicing the fundamentals of basketball is provided. The apparatus includes a retrieving bowl adapted to connect to a basketball goal to recover a basketball, an adjustable, swivelable chute having upper and lower ends, the upper end being connected to the retrieving bowl, and a base unit. The base unit houses an ejection box connected to the lower end of the chute and a passing box. The ejection box has motor-driven speed control wheels adjacent thereto for ejecting a basketball. The passing box has a target area covered by a one-way flap. A gravity channel extends from the passing box to the ejection box.

11 Claims, 3 Drawing Sheets

APPARATUS FOR USE IN PRACTICING THE FUNDAMENTALS OF BASKETBALL

BACKGROUND OF THE INVENTION

If it hasn't already, basketball will likely soon supplant baseball as this nation's national pastime. The skyrocketing popularity of the National Basketball Association and collegiate basketball is unmatched by other sports, and has led to increased participation in basketball at all levels. As a basketball player's physical skills must be honed through hours and hours of practice, efforts have been directed to providing devices which facilitate a more efficient use of an individual's available practice time.

Heretofore, these devices have taken the form of basketball retrieval and return mechanisms as exemplified in U.S. Pat. Nos. 3,776,550; 4,579,340; 4,678,189; 4,714,248; and 5,060,940. These devices function to, in some form or fashion, return a ball shot at a basketball goal to the player. This allows the player more time to practice shooting skills, rather than chasing down stray balls. However, the devices are limited in their ability to assist a basketball player in sharpening physical skills other than shooting.

It is an object of this invention to advance the field of basketball training aids so that a solitary player may easily practice all aspects of the game.

SUMMARY OF THE INVENTION

The present invention improves the prior art by providing an apparatus for use in practicing the fundamentals of basketball having not only a basketball return feature, but also a passing control capability. In addition to returning shots, the invention allows the solitary player to practice passing and catching skills without the necessity of a partner. The present invention also provides an integrated system for practice management, including scoring and clocking features. Thus, the invention works to improve the skills involved in shooting, passing, and catching a basketball as well as to develop speed of hand and ball control.

A retrieving bowl is adapted to connect beneath a basketball goal. The retrieving bowl is connected to the upper end of an adjustable, swivelable chute. The lower end of the chute connects to a base unit. The base unit includes a means for capturing a ball passed to a target area located on the face of the base unit and a means for ejecting a ball delivered to the base unit through either the target area or the chute. The base unit is also able to pivot, allowing the user to maneuver about the basketball court during practice.

In its preferred embodiment, the invention is hooked securely to the basketball backboard and rim. The apparatus recovers, via the retrieving bowl, all basketballs shot in the direction of the basketball goal, if the shot is made or missed within a close range of the basketball goal. After the ball is recovered, it travels part way through the chute, where it lodges at a timer gate. At the appropriate time, the ball is released to travel through the remainder of the chute to the base unit. An ejection box containing motor driven spinning wheels is located in the base unit and is designed to fire the ball back to the player at a predesignated spot on the basketball court.

On the face of the base unit opposite the ejection box is a passing zone box which allows the player to practice passing techniques. When the ball enters the passing zone box it is captured, and, via a gravity channel or conveyer belt, it is fed to the motor driven spinning wheels of the ejection box and is thereby delivered back to the player.

The apparatus of the preferred embodiment also has a pivot point in the base unit with a suction pad to secure the device directly under the goal. There are remote controlled motor driven wheels on each side of the base unit which rotate the machine from one side to the other through 180 degrees. This allows the player to start shooting from one side of the court and work back to the other side with the device recovering the balls shot through or near the goal and returning them to the player. Because the base unit pivots, the user benefits by practicing from various positions across the court. The timing of the movement of the machine can be altered. The apparatus may also be equipped with a scoreboard to count the number of shots taken or made and a clocking device to monitor the total time spent in practice.

Still other objects and advantages of the present invention will become readily apparent to those skilled in this art from the following detailed description, wherein there is shown and described only the preferred embodiments of the invention, simply by way of illustration of the best mode contemplated for carrying out the invention. As will be realized, the invention is capable of modifications in various obvious respects, all without departing from the invention. Accordingly, the description should be regarded as illustrative in nature, and not as restrictive.

DETAILED DESCRIPTION OF THE PREFERRED EMBODIMENT

Figure 1:
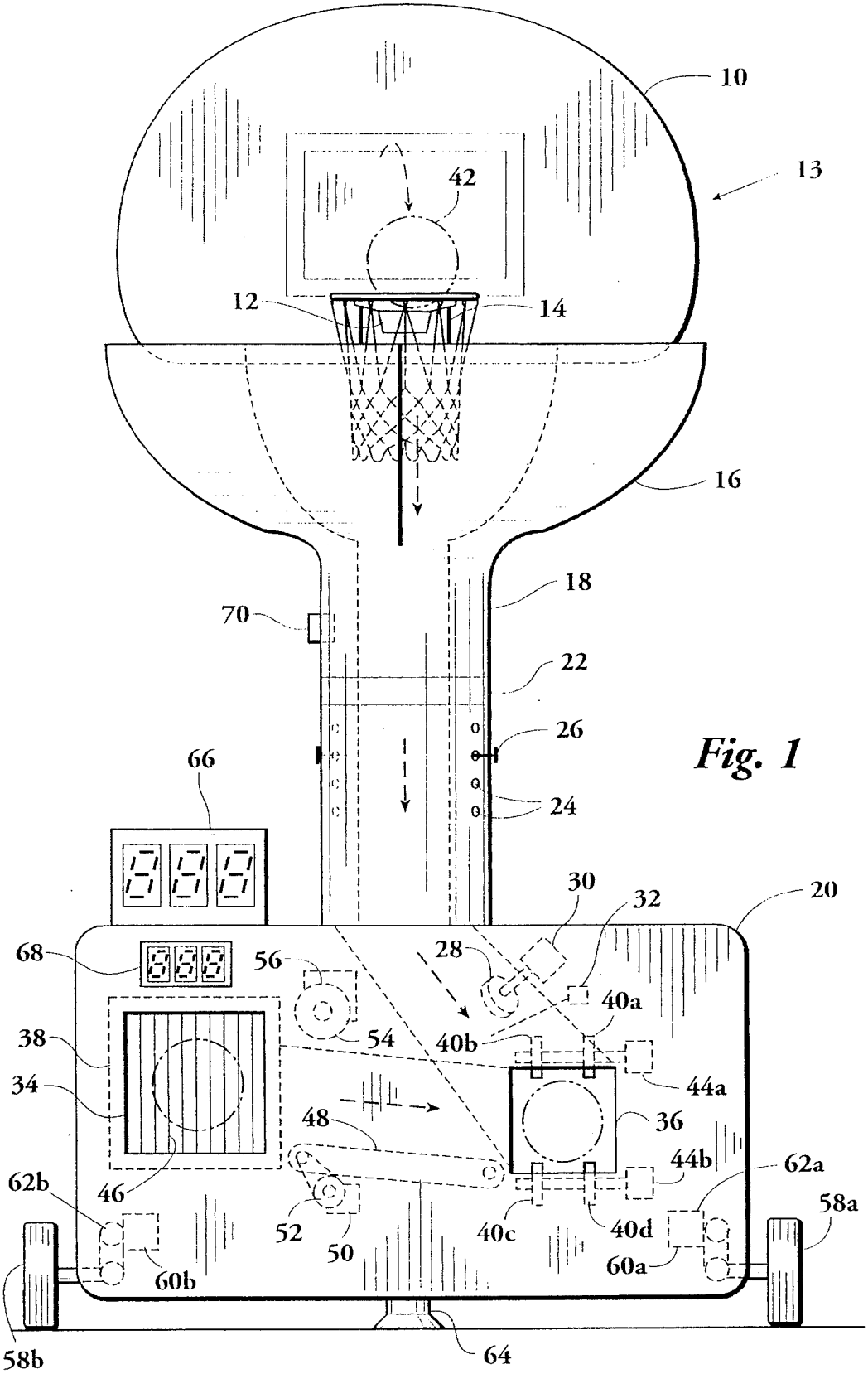
FIG. 1 is a front view of the apparatus of the present invention.
Figure 2:
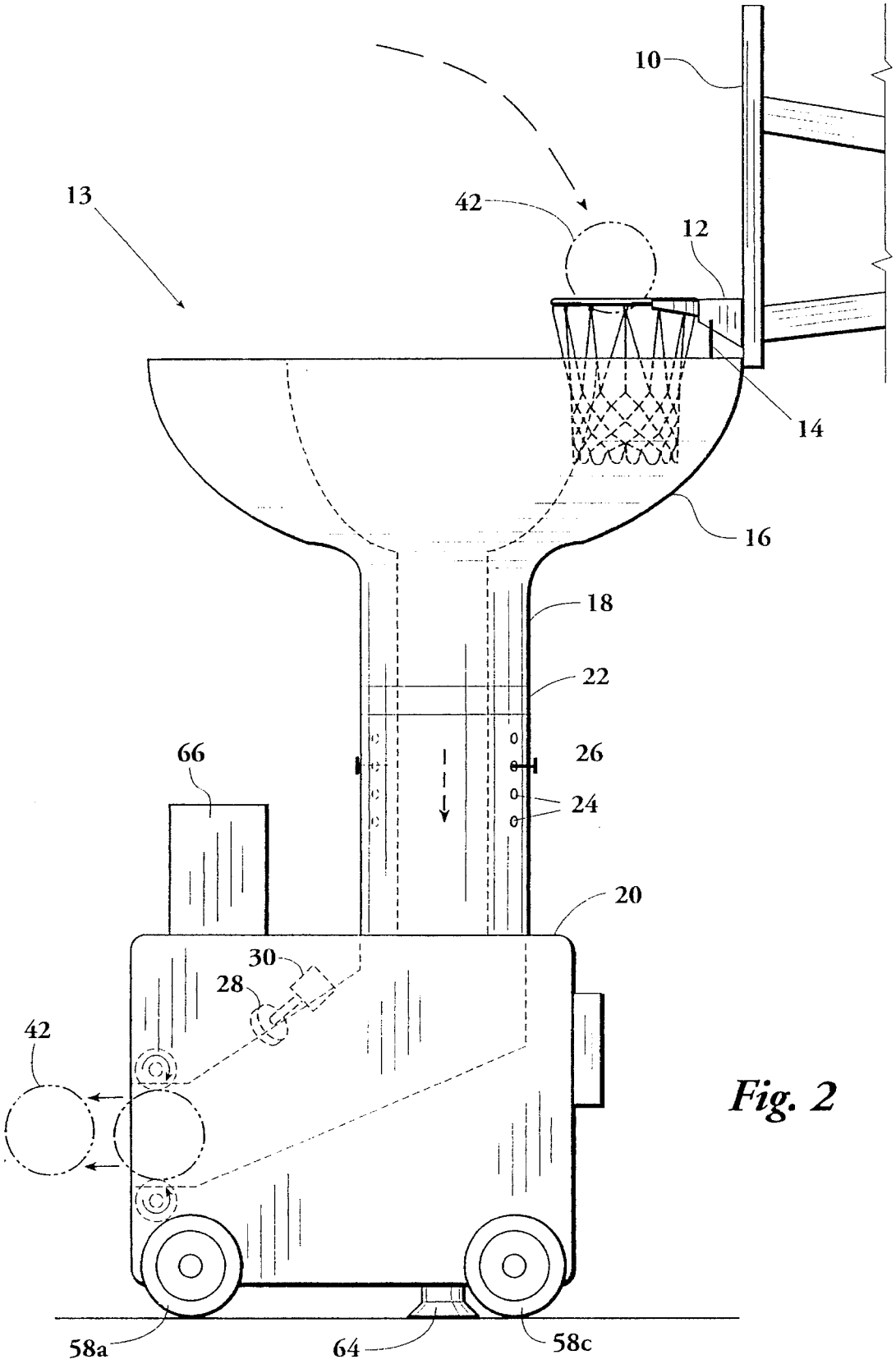
FIG. 2 is a side view of the apparatus of the present invention.

Referring to FIGS. 1 and 2, the element number 10 indicates a basketball backboard. Backboard 10 in conjunction with a rim 12 comprise a standard basketball goal 13. The present invention is affixed in place for use by two connecting rods 14, which attach the base of rim 12 to a retrieving bowl 16. Retrieving bowl 16 is aligned beneath rim 12 and is contoured so as to form a chute 18. Chute 18 attaches to, and is angled to pass through, a base unit 20.

Chute 18 includes a swivel joint 22 which allows for the rotation of base unit 20. Chute 18 also is provided with several adjustment holes 24 through which are placed adjustment pins 26. Adjustment holes 24 and adjustment pins 26 allow for the vertical adaptation of chute 18 to enable the invention to be raised or lowered to account for goal height variations. Within base unit 20 at the lower end of chute 18 (its end opposite retrieving bowl 16) is a speed control wheel 28 which is connected to an electric motor 30. Speed control wheel 28 in connection with a timer switch 32 controls the progression of a ball 42 through chute 18 and base unit 20.

Base unit 20 contains a means for capturing a ball passed to a target area 34 located on the face of the base unit and a means for ejecting a ball delivered to base unit 20 through either target area 34 or chute 18. In FIG. 1, two portals, an ejection box 36 and a passing box 38, are shown to satisfy these functions. Ejection box 36 is provided with a plurality of speed control wheels 40*a–d* that serve to expel ball 42 to the user. Speed control wheels 40*a–b* are driven by electric motor 44*a*, while speed control wheels 40*c–d* are driven by electric motor 44*b*.

Passing box 38 is generally defined by target area 34. When the user directs a pass to target area 34, the ball passes through a facing 46, which is a one-way covering, into passing box 38 wherein it is captured. The captured ball is then transferred via a conveyor belt 48 to ejection box 36 for return to the user. Conveyor belt 48 is operated by an electric motor 50 coupled to a pulley 52. An alternative to conveyer belt 48 is a gravity channel which can transfer a ball from passing box 38 to ejection box 36 by way of a sloped plank. Another speed control wheel 54 coupled with an electric motor 56 may be used to control the delivery of a ball from passing box 38 to ejection box 36.

Means other than those depicted in FIG. 1 may be used to perform the retrieval and return functions. By way of illustration, gravity, pressure, plunger or piston return systems, all known in the art, could be used as a return mechanism in lieu of speed control wheels 40*a–d* and electric motors 44*a–b*. Similarly, any of the same type systems coupled with a wedge-type capture system, a collapsible capture mechanism or the like, could be used instead of passing box 38, facing 46, and conveyor belt 48.

Figure 3:
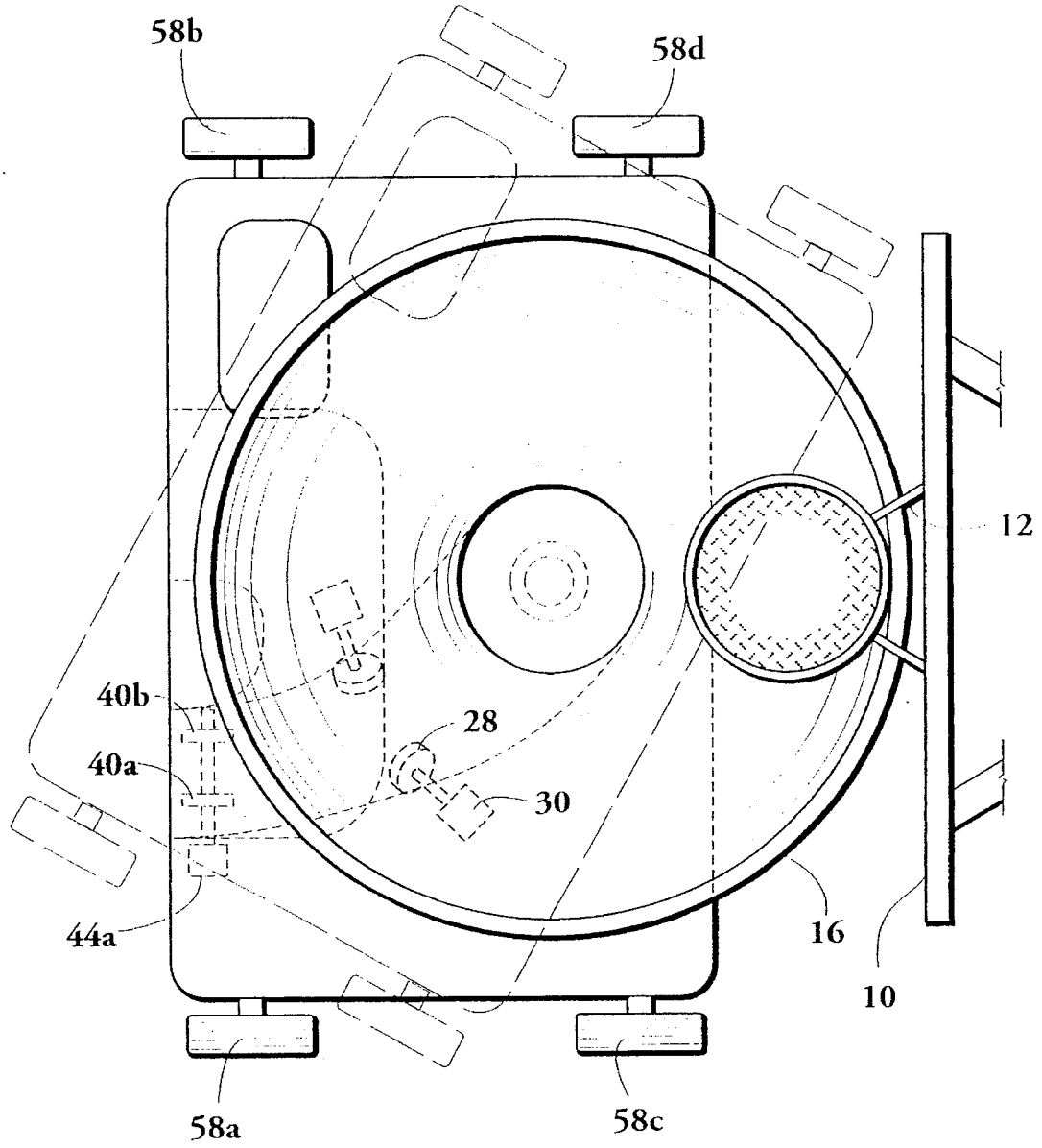
FIG. 3 is a top view of the apparatus of the present invention.

A means is also provided for pivoting base unit 20 about its axis. Referring now to FIGS. 1, 2 and 3, on each side of the apparatus at the bottom of base unit 20 are wheels 58*a–d*. Wheels 58*a–d* are controlled by electric motors 60*a–b* coupled with pulleys 62*a–b*. Wheels 58*a–d* allow the apparatus to pivot around a pivot control 64, which can be a suction pad or any similar position holding mechanism, from one side to another about an axis corresponding to the vertical portion of chute 18. Other means for pivoting base unit 20 are acceptable; for example, a single motor may be configured to rotate pivot control 64, thereby rotating the device.

A scoreboard 66 and a clocking means 68 allow the user to receive feedback on the number of balls passed through chute 18 and the total elapsed practice time. Scoreboard 66 is in communication with a sensor 70, located within chute 18. Sensor 70 detects the passing of a ball through chute 18 and transmits such information to scoreboard 66.

To utilize the present invention, the user first secures the device to the basketball goal 13, using adjustment pins 26 and adjustment holes 24 to fix the height of retrieving bowl 16 and connecting rods 14 to fasten the apparatus to the base of rim 12. The device is then connected to a standard 110 volt power source which supplies power to the various electric motors. If the user desires to practice shooting, he begins by aiming ball 42 at rim 12. As ball 42 descends through rim 12, or generally about the area around rim 12, it is recovered by retrieving bowl 16 and fed into chute 18. As ball 42 travels down chute 18 sensor 70 records its passage on scoreboard 66. Speed control wheel 28 and timer switch 32, having been preset by the user, control the passage of ball 42 to ejection box 36. Upon reaching ejection box 36, ball 42 is expelled to the user by speed control wheels 40*a–d*. The force with which ball 42 is ejected from ejection box 36, and the amount of spin imparted on ball 42, may also be controlled by the user through electric motors 44*a–b*.

To practice passing drills, ball 42 is directed by the user toward target area 34. If the pass is on target, ball 42 passes through facing 46 and is captured by passing box 38. Ball 42 is then transferred via conveyor belt 48 to ejection box 36 for return to the user. If the user prefers to maneuver about the basketball court while passing or shooting, he may set pivot control 64 and engage remote electric motors 60*a–b*. Such will cause base unit 20 to pivot about pivot control 64 at an adjustable rate.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An apparatus for use in practicing the fundamentals of basketball, comprising;

a. a retrieving bowl adapted to connect to a basketball goal to recover a basketball;

b. a chute having upper and lower ends, the upper end being connected to the retrieving bowl; and c. a base unit having:

(1) an ejection box connected to the lower end of the chute;

(2) means for capturing a basketball passed at a target area;

(3) means for transporting a captured basketball to the ejection box; and (4) means for ejecting a basketball delivered to the ejection box from the transporting means or the chute.

2. An apparatus according to claim 1, further comprising a means for pivoting the base unit.

3. An apparatus according to claim 1, wherein the means for capturing a passed ball comprises a passing box having a one-way flap which traps a ball passed at the target area.

4. An apparatus according to claim 1, wherein the means for transporting a captured basketball to the ejection box comprises a motor-driven conveyor belt.

5. An apparatus according to claim 1, wherein the means for transporting a captured basketball to the ejection box comprises a gravity channel.

6. An apparatus according to claim 1, wherein the ejecting means comprises motor-driven speed control wheels.

7. An apparatus according to claim 1, further comprising a scoreboard adapted to record the passage of a basketball through the chute.

8. An apparatus according to claim 1, further comprising a clocking mechanism for indicating elapsed time in use.

9. An apparatus according to claim 1, further comprising means for adjusting the height of the chute.

10. An apparatus according to claim 1, wherein the chute is provided with a swivel joint.

11. An apparatus for use in practicing the fundamentals of basketball, comprising;

a. a retrieving bowl adapted to connect to a basketball goal to recover a basketball;

b. an adjustable, swivelable chute having upper and lower ends, the upper end being connected to the retrieving bowl; and c. a base unit having:

(1) an ejection box connected to the lower end of the chute, the ejection box having motor-driven speed control wheels adjacent thereto;

(2) a passing box having a target area covered by a one-way flap; and (3) a gravity channel extending from the passing box to the ejection box.

* * * * *